United States Patent [19]

Reid et al.

[11] 4,141,645

[45] Feb. 27, 1979

[54] TONER CONCENTRATION MONITOR

[75] Inventors: Michael G. Reid; Stephen R. Rowell, both of Rochester, N.Y.

[73] Assignee: Eastman Kodak Company, Rochester, N.Y.

[21] Appl. No.: 820,270

[22] Filed: Jul. 29, 1977

[51] Int. Cl.[2] ..... G03G 15/09

[52] U.S. Cl. ..... 355/3 DD; 222/DIG. 1

[58] Field of Search ..... 118/646; 222/DIG. 1; 250/573; 355/3 DD, 14; 356/212

[56] References Cited

U.S. PATENT DOCUMENTS

| | | | |
|---|---|---|---|
| 3,233,781 | 2/1966 | Grubbs | 356/212 X |
| 3,575,505 | 4/1971 | Parmigiani | 355/14 X |
| 3,876,106 | 4/1975 | Powell et al. | 222/DIG. 1 |
| 4,026,643 | 5/1977 | Bergman | 355/3 DD |

OTHER PUBLICATIONS

Stephens, "Electrophotographic Apparatus Having Compensation for Changes in Sensitometric Properties of Photoconductors", Research Disclosure, No. 146, Jun. 1976, pp. 4–6, 355–414.

*Primary Examiner*—A. D. Pellinen
*Attorney, Agent, or Firm*—Raymond L. Owens

[57] ABSTRACT

Apparatus for monitoring the concentration of toner particles in an electrographic developer mixture having toner and carrier particles in which a first signal is produced representative of the reflectivity of the developer mixture and an offset signal is produced representative of changes in the reflectivity of the developer mixture caused by the build up of a film of toner on the carrier particles. A computation device such as a digital computer in response to the first signal and the offset signal provides a correct representation of the concentration of toner in the developer mixture. When the toner concentration is below a desired level, the computation device actuates a toner replenishment mechanism which adds fresh toner to the developer mixture.

8 Claims, 3 Drawing Figures

TONER CONCENTRATION MONITOR

BACKGROUND OF THE INVENTION

1. Field of the Invention

The invention relates to apparatus for determining the concentration of toner particles in electrographic developer mixtures. More specifically, this invention relates to toner concentration monitoring apparatus of the type wherein toner concentration is determined by sensing the reflectivity of the developer mixture. Fresh toner is added when needed to maintain the toner concentration at a desired level.

2. Description of the Prior Art

In the electrographic reproduction process, the surface of a radiation-sensitive photoconductive member which may comprise a layer of photoconductive material disposed on a conductive backing, is given a uniform electrostatic charge and is then image-wise exposed to a pattern of actinic radiation corresponding to the indicia on a document or the like being reproduced. Such exposure serves to selectively dissipate the uniform charge on the surface, leaving behind a latent electrostatic image which can then be developed by contacting it with an electrographic developer mixture.

In general, electrographic developer mixtures comprise a mixture of suitably pigmented or dyed resin-based electroscopic particles, known as toner, and a granular carrier material which functions to carry such toner by generating triboelectric charges thereon. The development of the latent electrostatic image occurs when the developer mixture is brought into contact with the electrostatic image-bearing surface. Such contact is commonly effected by either cascading the mixture over such surface or brushing the surface with one or more rotating magnetic development brushes, the "bristles" of which comprise chain-like arrays of toner-carrying carrier particles. Upon contacting the electrostatic image-bearing surface, the toner particles, being charged to a polarity opposite to that of the electrostatic image, are separated from the carrier particles and are selectively deposited in an imagewise configuration on the image-bearing surface to form a developed image which may thereafter be transferred to a paper receiving sheet and fixed thereto by any suitable means, such as heat, to form a copy of the original document. As successive toner images are formed, toner particles are depleted from the developer mixture, requiring subsequent replenishment to avoid a gradual reduction in image density.

To avoid the necessity of periodic manual replenishment and the operating difficulties often encountered as a result of over-replenishment, a variety of devices has been heretofore proposed for automatically replenishing toner particles. Exemplary of photoelectric or optical toner concentration monitoring devices is the device disclosed in U.S. Pat. No. 3,233,781 issued to W. J. Grubbs which utilizes the reflectivity of a developer mixture having toner and carrier particles as a means for monitoring the concentration of toner particles in the developer mixture. Toner particles, usually being black, possess light absorbing surfaces and reflect less radiant energy than the carrier particles. Thus, the reflectivity of the developer mixture depends upon the relative proportions of the mixed particles. According to the Grubbs disclosure, the reflectance of the developer mixture is monitored by directing light from an incandescent lamp toward the developer mixture and detecting the light reflected by the developer mixture with a photocell. This photocell along with a similar photocell which is illuminated directly by the lamp are employed as variable resistance arms of a bridge circuit. The bridge circuit activates a toner replenishing device in response to a predetermined change in the ratio of photocell outputs, such change being characterized by an unbalance in the circuit.

While operable, photoelectric toner monitoring devices of the type described above have not proven entirely satisfactory in operation, especially over extended periods of time.

A significant advance is disclosed in commonly assigned U.S. Pat. No. 3,876,106 to Rowell et al issued Apr. 8, 1975 which discloses an apparatus that overcomes many of the above-described prior art problems. In the Rowell apparatus a light emitting diode (LED) illuminates a developer mixture of toner and carrier particles. The apparatus includes first and second photo-sensitive means, the first being disposed to receive radiation from the LED reflected from the developer mixture and the second being disposed to receive radiation directly from the LED. The first and second photosensitive means produce first and second analog signals representative of the reflectivity of the developer mixture and the intensity of the radiation of the LED, respectively. The first and second analog signals are then converted to digital signals.

This apparatus further includes a digital processing apparatus having a programmable digital computer with a stored program which in response to such first and second digital signals produces in accordance with such stored program a representation of the toner concentration of the developer mixture. Further, the apparatus from time to time adds fresh toner to the developer mixture to maintain a substantially constant developer mixture reflectance.

It has been observed that with usage of a developer mixture, the reflectivity of the developer mixture can not be faithfully used to determine toner concentration of the developer mixture. It is believed that the change in developer mixture reflectivity can be directly attributed to carrier particle scumming. By scumming it is meant that as the developer mixture is used or ages, the mechanical friction between the toner and carrier particles causes a film of toner to be coated on the outer surface of the carrier particles. As carrier particle scumming increases, the reflectivity of the carrier particles and consequently the developer mixture decreases. Thus prior apparatus may determine, based solely upon developer mixture reflectivity, that the toner concentration is higher than it actually is.

SUMMARY OF THE INVENTION

In the disclosed embodiment there is provided means for producing a first signal which is a function of the reflectivity of the developer mixture, and means for producing an offset signal representing changes in developer mixture reflectivity caused by scumming of the carrier particles. Computation means such as a digital computer respond to the first signal and the offset signal to provide a correct indication of the concentration of toner in the developer mixture.

DETAILED DESCRIPTION OF A PREFERRED EMBODIMENT

To assist the understanding of the present invention, the operation of an electrographic copying machine in which the invention may be used will be briefly described. It is to be understood, however, that the apparatus of the present invention could be used with equal facility and advantage in other copying machines, and, therefore, that the following description of apparatus related to but not forming part of the invention is provided for illustrative purposes only.

Electrographic Copy Apparatus

Figure 1:
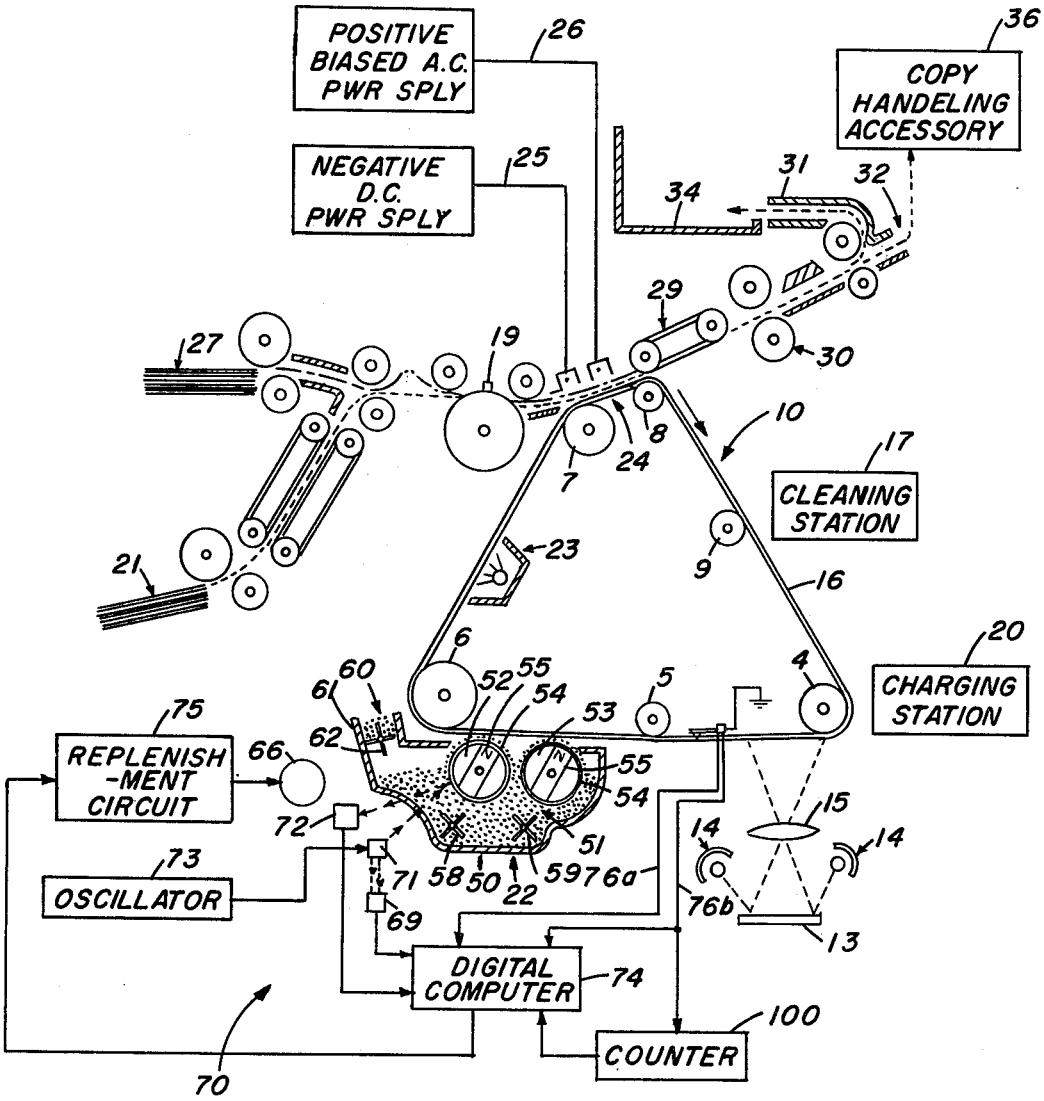
FIG. 1 is a schematic vertical section of an electrographic apparatus including a toner concentration monitor embodying the invention.

Reference is now made to FIG. 1 wherein various stations of an electrographic apparatus 10 are schematically illustrated. A charging station 20 lays down a uniform charge on a photo-sensitive web member 16 (also referred to hereinafter as a "film") which is trained about rollers 4 through 9. As in some electrographic copiers, an information medium 13 such as a document is illuminated by radiation from flash lamps 14. Such radiation is reflected from the medium and projected by a lens 15 onto the photosensitive web member 16 to selectively dissipate charge and form an electrostatic latent image on an image area or film frame. The photosensitive web member 16 is relatively transparent and may include a photoconductive layer with a conductive backing on a polyester support. The photoconductive layer may be formed from, for instance, a heterogeneous photoconductive composition such as dislcosed in the commonly assigned U.S. Pat. No. 3,615,414, issued Oct. 24, 1971. Assuming that the information on the document 13 is black on a white background, the photoconductive layer of web member 16 is rendered conductive in areas corresponding to the original background, leaving a latent image of negative charge only in areas corresponding to the original black image.

The apparatus 10 further includes a magnetic brush development station 22 at which the moving electrostatic image is contacted by toner particles formed from a fine thermoplastic powder. The particles adhere by electrostatic attraction to the negatively charged portions of the electrostatic image to develop and render such image visible. A post-development erase lamp 23 such as disclosed in commonly assigned U.S. Pat. No. 3,615,414 issued Oct. 24, 1971 then illuminates the photoconductive layer of web 16, through the relatively transparent support and conducting layers to reduce photoconductor electrical fatigue (deterioration resulting from prolonged electrical stress).

A transfer station 24 is provided to cause toner particles to be transferred in an imagewise configuration to a receiving surface of a copy sheet of paper. The sheets are fed seriatim from a selected one of two paper supplies 21 and 27 through a registration device 19 and then onto the surface of the web member 16 at the transfer station 24. The transfer station includes a negatively charged DC corona device 25 for transferring the toner particles from the web member onto the paper. The paper and web member 16 then move under an AC corona device 26 which renders the paper virtually neutral in charge.

Since the web member bends sharply around the roller 8, the beam strength of the paper coupled with the momentum of the moving paper causes the paper to leave the web member 16. A vacuum transport member 29 is located above the photoconductor at this point to convey the paper into a fusing station 30. At the fusing station 30, the toner is fused by heat and pressure to the paper provide a final substantially permanent copy. This copy follows either of the paths labeled 31 or 32 in exiting from the machine to either a hopper 34 or copy handling accessory 36 such as a sorter or a finisher. Finally, a cleaning station 17 is provided in which residual toner is removed from the photoconductive layer of the web member 16 prior to charging.

The development station 22 includes a trough 50 for containing an electrographic developer mixture 51 and a pair of conventional magnetic development brushes 52 and 53. Each brush generally includes a rotatably mounted aluminum cylinder 54 having at least one magnetic pole piece 55, interiorly disposed in a fixed position along the longitudinal axis thereof. A pair of rotating mixing augers 58 and 59 circulate the developer laterally through 50 and maintain the relative concentrations of the developer mixture components substantially constant throughout the trough 50.

As cylinders 54 rotate, developer mixture 51 collects on the outer surfaces thereof under the influence of the magnetic field produced by the internal pole pieces 55. As the electrostatic image-bearing surface of web member 16 tangentially contacts with the developer-bearing cylinders, toner is stripped from the carrier particles, due to the stronger electrostatic forces, and selectively deposited on the web member to form toner images. As the cylinders 54 continue to rotate, the partially denuded carrier particles used in forming the toner images are moved beyond the influence of pole pieces 55 and fall back into the main body of the developer to be recoated with toner. An example of an exemplary magnetic development station 22 is more fully disclosed in commonly assigned U.S. Pat. No. 3,543,720 to Drexler et al.

A conventional toner replenisher 60 is activated by a toner concentration monitor (to be described) to maintain the concentration of toner within a range required for high quality copies. The replenisher 60 includes a hopper 61 which defines an opening in which is disposed a paddle wheel 62 which may also be in the form of a brush or soft fibrous roller. The wheel 62 is driven by a motor 66. When the motor 66 is energized, it rotates the paddle wheel 62 causing toner to be fed into the trough 50 thereby increasing the concentration of toner in the developer mixture 51. An example of a conventional toner replenisher is set forth in U.S. Pat. No. 3,409,901.

Toner Concentration Monitor Apparatus

The carrier and toner components of the developer mixture commonly possess divergent reflectance characteristics, with toner having a lower reflectivity than the carrier component. As is well known, the lower the concentration of the toner particles, the higher the reflectance of the developer mixture. Stated differently, the developer 51 reflectance is inversely proportional to the toner concentration. However, as the developer mixture is used, the mechanical friction between the toner and carrier particles causes toner to build up on the surface of the carrier particles (scumming). This toner build up causes the reflectivity of the carrier particles to decrease. Thus, without some compensation, the toner concentration monitor may provide a false reading. Carrier scumming is directly related to the number of film frames that are processed. In accordance with the invention the number of image exposures are counted. As will be described hereinafter an offset voltage signal is increased at numbers predetermined of exposures to compensate for changes in developer mixture reflectivity due to carrier scumming. This offset signal is added to the mixture reflectivity signal before toner concentration is computed.

As shown in FIG. 1, there is provided a toner concentration monitor apparatus 70 which monitors the concentration of toner in the developer mixture 51. Monitoring of the reflectance of the developer mixture 51 is accomplished by directing the output of radiant energy source 71, preferably a light emitting diode, toward a portion of the developer mixture where the concentration is representative of the average toner concentration throughout the developer mixture. In the magnetic brush development station 22, the toner concentration of the developer mixture on the downstream development brush (i.e. brush 52) between the points where the brush surface emerges from the trough 50 and first contacts the surface of web member 16 is usually characteristic of the average toner concentration of the developer mixture. Between such points, the surface of the development brush is covered by developer mixture which has not yet been subjected to the localized depletion of toner as a result of developing electrostatic images.

Figure 2:
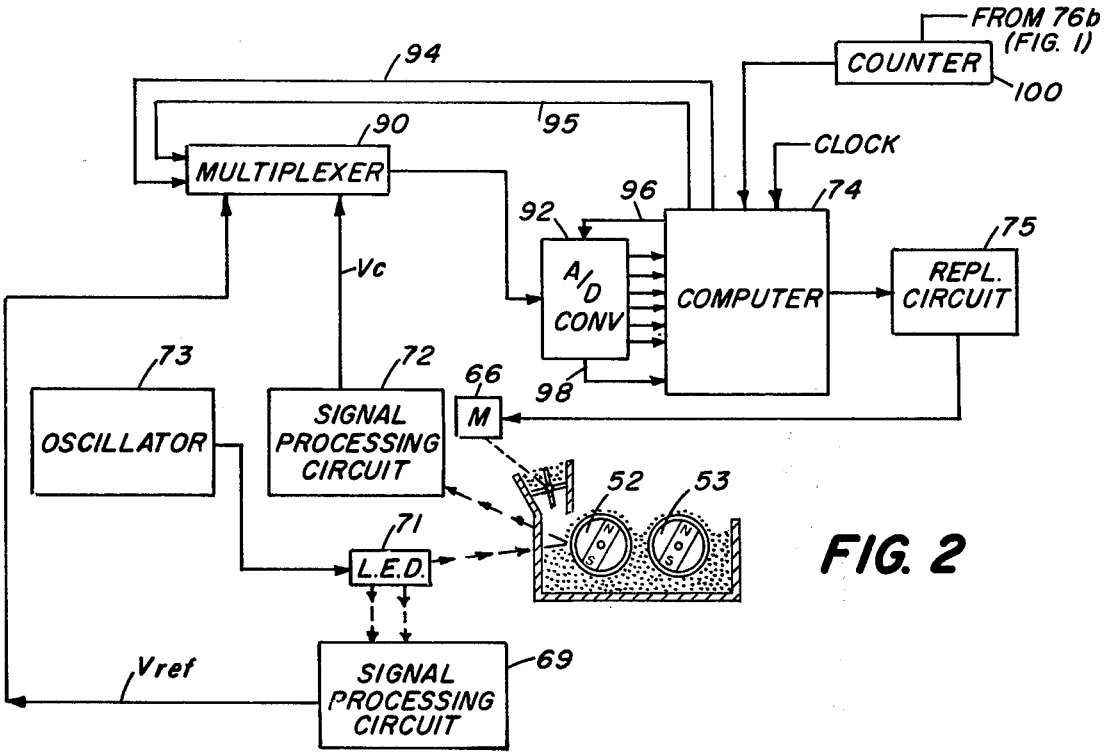
FIG. 2 is a block diagram showing in more detail the toner concentration monitor depicted in FIG. 1.

Because of its fast response time, an LED 71 can be pulsed at very high speeds. The LED 71 is actually periodically energized at a selected frequency by means of a conventional oscillator 73. Light reflected from the brush 52 is received and processed by signal processing circuitry 72. Light from LED 71 is also received directly by signal processing circuit 69. Circuits 69 and 72 are shown at this point for the sake of convenience in the disclosure as applying signals directly into a programmable digital computer 74. The circuits 69 and 72 will be understood to include appropriate low-pass filters. These filters aid in noise rejection. As will be seen when FIG. 2 is discussed, these signals are actually multiplexed and converted to a digital format prior to being received by the computer 74. The computer 74 also receives input signals from a pair of electromechanical transducers **76*a* and 76*b* (referred to herein as bimorph sensors) which sense perforations in the web member 16 to provide timing information for controlling the operation of the various copier work stations. The bimorph 76*b* provides a pulse signal every time a copy image has been exposed. These signals are provided to a counter 100 which totalizes them. The computer receives signals representative of the number of frames exposed from the counter 100. The counter 100** is a non-volatile storage register that stores the film frame count. A non-volatile memory will be understood to be one where the loss of power will not cause a destruction of its contents.

Turning now to FIG. 2, there is shown a more detailed block diagram of the toner concentration monitor 70 in accordance with the invention. As shown, the oscillator 73 provides a drive current for the LED 71 which illuminates the brush 52 with light in the infrared portion of the spectrum. The spectral region where developer reflectance is monitored should be chosen in accordance with the availability and operational requirements of commercial light-emitting diodes and photodetectors. Light from the brush 52 is reflected to illuminate the signal processing circuit 72 which includes a detector device such as a phototransistor operating between base and collector junctions as a photovoltaic cell. The detected signal is amplified and converted to a DC level by the circuit 72. The output signal $V_C$ is a voltage level and represents the reflectivity of the developer mixture but is not yet compensated for carrier scumming. The signal $V_C$ is applied to an analog multiplexer 90 which at the appropriate time, selected by the computer 74, provides such signal to an analog to digital (A/D) converter 92.

Since a variation in the intensity of the light from LED 71 could cause a signal to be produced by the circuit 72 which could indicate a wrong toner concentration, the multiplexer 90 receives a reference voltage $V_{REF}$ produced by circuitry 69. The multiplexer 90 also applies this signal to the A/D converter 92, which at the appropriate time applies it to the computer 74. In response to signals $V_C$ and $V_{REF}$ the multiplexer compensates for variations in light intensity. This process will now be described. The circuitry 69 receives light directly from the LED 71. In a preferred embodiment, the energy output of the LED 71 may be coupled to a detector of the circuit 69 by means of a conventional light pipe (not shown). If a light pipe is used, problems of toner dust in the optical path may be minimized. The circuit 69 detects the light, amplifies and converts it to a DC reference voltage level $V_{REF}$. The $V_{REF}$ signal is also applied to the multiplexer 90 which, at the appropriate time feeds its multiplexed output to the A/D converter 92 which in turn applies a corresponding six bit digital word into the computer 74. The arrangement is such that if the concentration of toner in the developer mixture is at the desired level the amplitude of both analog input signals $V_{REF}$ and $V_C$ are adjusted by circuits 69 and 72, respectively to have the same amplitude. Stated mathematically $$\left(\frac{V_{REF} - V_C}{V_{REF}}\right) = 0.$$

However, and again assuming no carrier scumming, if the mixture reflectivity is reduced, $V_C$ will diminish and $$\frac{V_{REF} - V_C}{V_{REF}}$$

will be a positive number which indicates that the toner concentration is above the desired level.

In order to process signals from the circuits 69 and 72, the computer 74 produces multiplexer channel address select signals to sequentially switch inputs to the A/D converter 92. These signals are sequentially produced after a perforation has been detected by sensor **76*b*. Thereafter, start signals are produced in the lead 96 which causes the A/D converter 92 to perform a conversion of input analog data into six bit digital words. Upon completion of each such A/D conversion process, the converter produces a completion signal which is delivered to the computer 74 via a lead 98. This completion signal causes the computer in the appropriate sequence in its program to accept the date from A/D converter 92. As noted above, the sequencing of the computer is in turn coordinated as a function of the input signals provided by the transducers 76a and 76b upon sensing the perforations in the web member 16. If the computer determines toner is to be added to the mixture it provides an output signal to the replenishment circuit 75 which in turn energizes the replenishment motor 66. The circuit 75 will continue to receive these output signals until the computer 74** determines that the toner concentration is back within a desired range. Also, the computer may be programmed to monitor the magnitude of toner concentration and provide output operator alert signals if the toner concentration becomes either too high or too low.

The computer 74 also received a signal from counter 100 representative of the number of frames processed. This number is directly related to the usage of the developer mixture. The computer includes in memory a look up table which has an offset voltage signal V offset corresponding to each number of film frames processed. The computer then adds the signal $V_{offset}$ to $V_C$. Stated mathematically this becomes $$\left(\frac{V_{REF} - V_C + V_{offset}}{V_{REF}}\right) \text{or } 1 - \left(\frac{V_C + V_{offset}}{V_{REF}}\right)$$

a number is computed which is equal to zero when no toner is needed. If it is a negative number, such number represents that the toner concentration is below the desired level and the computer may require an addition of fresh toner. It should be understood that a serviceman should reset the counter 100 upon installation of a new developer mixture.

For a specific example, let us assume that the computer automatically increases the voltage $V_{offset}$ at predetermined numbers of exposure intervals to compensate for the change in developer mixture reflectivity due to carrier scumming. Further let us assume that voltage compensation increments of 0.1 volts will be used at 25,000,125,000, and 225,000 exposures. Let us further assume that toner concentration is determined every five frames counted by counter 100.

Figure 3:
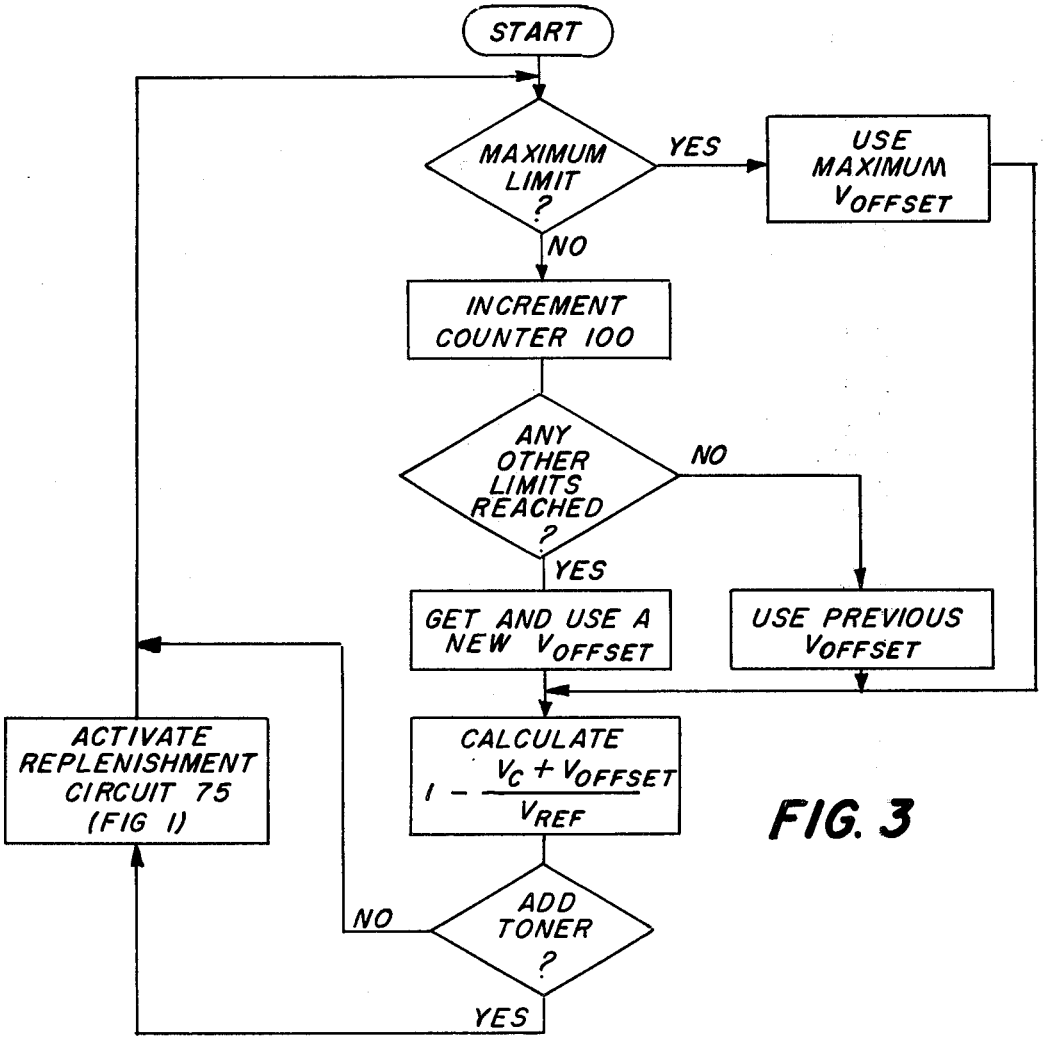
FIG. 3 is a flow chart of the sequences of operation of the toner concentration monitor of FIG. 2.

FIG. 3 depicts a flow chart which describes the process the computer 74 uses to calculate toner concentration. First the computer determines if the total number of frames is equal to or exceeds the maximum limit, 225 thousand frames (225K). If the answer is yes, then the maximum $V_{offset}$ (0.3 Volts) is used by the computer to calculate $$1 - \left(\frac{V_C + V_{offset}}{V_{REF}}\right).$$

Next the computer 74 determines, if a negative number is calculated. If it is negative, toner is needed and the replenishment circuit 75 is activated, motor 76 energized, and fresh toner added to the developer mixture.

Returning to the beginning of the flow chart, let us assume that the maximum limit (225K) was not reached. The counter 100 is then incremented. The next decision to be made is: are any other limits (i.e. 25K or 125K) reached. If the answer is no, the previous $V_{offset}$ will be used. For example, let us assume that a count of 117 thousand is held in counter 100, then $V_{offset} = 0.1$ volts. On the other hand, if the 125K limit is reached, then a new $V_{offset}$ 0.2 will be used in the calculation.

Reviewing, the computer 74 at predetermined exposure intervals, computes $$1 - \left(\frac{V_C + V_{offset}}{V_{REF}}\right).$$

If the number computed is negative, then fresh toner is added. $V_{offset}$ is introduced to compensate for loss of reflectivity of the developer mixture due to carrier scumming that occurs with aging of the developer mixture.

The invention has been described in detail with particular reference to a preferred embodiment thereof, but it will be understood that variations and modifications can be effected within the scope of the invention.

We claim:

1. Apparatus for determining the concentration of toner particles in a developer mixture having toner and carrier particles, comprising:

(a) means for producing a first signal representative of the reflectivity of the developer mixture;

(b) means for producing an offset signal representative of a change in developer mixture reflectivity caused by scumming of the carrier particles; and (c) means responsive to said first signal and said offset signal for producing a signal representative of the concentration of toner particles in the developer mixture.

2. In electrographic apparatus of the type in which electrostatic images are created by image-wise exposure of a charged photoconductor and developed by toner from a developer mixture having toner and carrier components and in which the reflectivity of the developer mixture is related to the concentration of the toner components in the mixture and the scumming of the carrier components, a toner concentration monitor comprising:

(a) a radiation source for projecting radiant energy upon the developer mixture to illuminate a portion of the same;

(b) means disposed to receive radiation reflected from the developer mixture and in response produce a first signal representative of the reflectivity of such developer mixture;

(c) means for providing a second signal representative of the change in reflectivity caused by scumming of the carrier components of such developer mixture; and (d) computation means responsive to said first signal and said second signal for producing a signal representative of the concentration of toner components in the developer mixture.

3. In copier/duplicator apparatus which includes means for monitoring the proportion of carrier and toner particles of the developer mixture wherein the toner and carrier particles have divergent reflectance characteristics, the improvement comprising:

(a) a radiation source for projecting radiant energy upon the mixture to illuminate a portion thereof;

(b) first and second photosensitive means, said first photosensitive means being disposed to receive radiation from said source which is reflected from the mixture and said second photosensitive means being disposed to receive radiation directly from said source, said first and second photosensitive means being adapted to produce first and second analog signals representative of the reflectivity of said mixture and the intensity of radiation of said source, respectively;

(c) analog to digital conversion means responsive to said first and second analog signals to respectively produce first and second digital signals corresponding thereto;

(d) means for producing a third digital signal representative of the change in reflectivity of said mixture caused by the scumming of the carrier particles of such developer mixture; and (e) programmable digital computation means having a stored program and being responsive to said first and second digital signals and to said third digital signal for producing in accordance with said stored program a representation of the proportion of toner particles in the developer mixture.

4. The invention as set forth in claim 3 wherein said digital computation means computes $$1 - \frac{V_C + V_{offset}}{V_{REF}}$$

to determine a number wherein:

$V_C$ is said first digital signal, $V_{REF}$ is said second digital signal, and $V_{offset}$ is said third digital signal such that if the computed number is negative it indicates that the toner concentration is below a desired level.

5. The invention as set forth in claim 4 wherein said third digital signal varies as a function of the number of developed images made by a particular developer mixture.

6. The invention as set forth in claim 4 including actuable toner replenishing means for adding toner particles to the developer mixture and wherein said programmable digital computation means actuates said actuable toner replenishing means when the computed number is a negative number.

7. A method for determining the concentration of toner particles in a developer mixture having toner and carrier particles, comprising the steps of:

(a) producing a first signal representative of the reflectivity of the developer mixture;

(b) producing an offset signal representative of a change in developer mixture reflectivity caused by scumming of the carrier particles; and (c) combining said first signal and said offset signal for producing a signal representative of the concentration of toner particles in the developer mixture.

8. A method according to claim 7 including the step of:

(e) adding toner particles to the developer mixture when the toner concentration is below a desired level.

* * * * *